US012485328B1

(12) United States Patent
Rich, Jr.

(10) Patent No.: US 12,485,328 B1
(45) Date of Patent: Dec. 2, 2025

(54) ADJUSTABLE WEIGHTED GOLF CLUB

(71) Applicant: John W. Rich, Jr., Gilberton, PA (US)

(72) Inventor: John W. Rich, Jr., Gilberton, PA (US)

( * ) Notice: Subject to any disclaimer, the term of this patent is extended or adjusted under 35 U.S.C. 154(b) by 0 days.

(21) Appl. No.: 19/229,749

(22) Filed: Jun. 5, 2025

(51) Int. Cl.

| | |
|---|---|
| ***A63B 53/00*** | (2015.01) |
| ***A63B 53/02*** | (2015.01) |
| ***A63B 53/04*** | (2015.01) |
| ***A63B 53/06*** | (2015.01) |
| ***A63B 60/04*** | (2015.01) |
| ***A63B 69/36*** | (2006.01) |

(52) U.S. Cl.
CPC ..... *A63B 60/04* (2015.10); *A63B 53/02* (2013.01); *A63B 53/0466* (2013.01); *A63B 2209/00* (2013.01)

(58) Field of Classification Search
CPC ..... A63B 53/00; A63B 2053/0495
See application file for complete search history.

(56) References Cited

U.S. PATENT DOCUMENTS 1,561,595 A * 11/1925 Davis ..... A63B 53/04 473/326
1,894,841 A * 1/1933 Adams ..... A63B 21/0602 473/326
2,432,450 A * 12/1947 Sears ..... A63B 60/24 473/297
3,037,775 A * 6/1962 Busch ..... A63B 60/24 473/282
3,993,314 A * 11/1976 Harrington ..... A63B 60/04 473/345
5,082,279 A * 1/1992 Hull ..... A63B 60/00 473/297
5,263,713 A * 11/1993 Taylor ..... A63B 60/00 473/329
5,316,300 A * 5/1994 Simmons ..... A63B 60/00 473/321
5,540,625 A * 7/1996 Koch ..... A63B 53/00 473/332

(Continued)

FOREIGN PATENT DOCUMENTS

JP S6160970 U * 4/1986
JP S6224871 U * 2/1987

(Continued)

*Primary Examiner* — Alvin A Hunter
(74) *Attorney, Agent, or Firm* — McHale & Slavin, P.A.

(57) ABSTRACT

A golf club with a dynamic weighting system that utilizes a fluent liquid medium to enhance swing efficiency and ball striking performance. The club includes a hollow shaft and a hollow club head, with internal cavities fluidly coupled to form a continuous chamber. An adjustable check valve assembly within the shaft allows for evacuation of air, creating a vacuum that retains the fluent medium within the sealed chamber. The check valve assembly comprises an expandable sleeve, a valve chamber with a frusto-conical lower section, a vacuum-responsive check valve, a vented stationary plate, and a safety lock to maintain vacuum integrity. During a swing, the fluent liquid weight medium shifts from the shaft to the club head to increase mass at the striking face at impact and then returns to the shaft during the backswing to reduce inertial resistance. This controlled mass redistribution optimizes energy transfer and increases the resulting distance of golf ball flight.

13 Claims, 7 Drawing Sheets

(56) References Cited

U.S. PATENT DOCUMENTS

| | | | | | |
|---|---|---|---|---|---|
| 5,632,693 | A * | 5/1997 | Painter | A63B 53/0466 | 473/332 |
| 5,803,829 | A * | 9/1998 | Hayashi | A63B 60/00 | 473/333 |
| 6,019,687 | A * | 2/2000 | Blowers | A63B 60/46 | 473/332 |
| 7,857,707 | B2 * | 12/2010 | Beppu | A63B 69/36 | 473/297 |
| 2008/0188322 | A1 * | 8/2008 | Anderson | A63B 60/00 | 29/527.4 |
| 2009/0149269 | A1 * | 6/2009 | Beppu | A63B 69/36 | 473/292 |

FOREIGN PATENT DOCUMENTS

| | | | | | |
|---|---|---|---|---|---|
| JP | S6241673 | A * | 2/1987 | | |
| JP | S63160868 | U * | 10/1988 | | |
| KR | 200190190 | Y1 * | 7/2000 | A63B 53/12 | |
| WO | WO-2007111272 | A1 * | 10/2007 | A63B 69/36 | |

* cited by examiner

ADJUSTABLE WEIGHTED GOLF CLUB

FIELD OF THE INVENTION

The present invention is directed to the game of golf and, more particularly, to club head weight transfer to provide a more powerful golf ball strike.

BACKGROUND OF THE INVENTION

When playing golf, a golf ball is struck by the club head attached to the end of a shaft. Driving a golf ball from a tee or the ground requires the golfer to take a backswing and then accelerates it forward during a downswing. At one point during the backswing, the club head is swung to its highest point before reversing club head direction wherein the downswing places the club head at its lowest point. The forward rotation resulting in the greatest club head speed.

The weight of a golf club plays a key role in generating distance when hitting a golf ball. A heavier club head, when swung at the same speed as a lighter one, carries more momentum. This means it can transfer more energy to the ball at impact, resulting in greater ball speed and, potentially, longer shots. A properly weighted club helps maximize the ratio of ball speed to clubhead speed. A heavier club head can improve energy transfer, especially if contact is centered on the face. Furthermore, a club with appropriate weight resists twisting on off-center hits, helping maintain direction and distance. If the club is too heavy, a golfer might not be able to swing it fast enough, which could reduce overall distance.

The distance to which a golf ball travels can be impacted by both the speed of the club head striking the golf ball and by the mass or weight of the club head striking the golf ball. Accordingly, attempts to reduce the weight of a club head enables greater and quicker acceleration of the golf swing but necessarily also reduces the mass or weight of the club head striking the ball, and attempts to increase the weight of the club head necessarily reduces the ability to accelerate the club head at the initial stage of the downswing.

When a golfer strikes a golf ball, the use of a wrist release helps increase distance. Holding the wrist angle until late in the downswing stores energy. Releasing that angle at the right moment "snaps" the club head through the ball, increasing its speed. The wrist release allows for a late release of energy, accelerating the club head right before contact. This last burst of speed can add significant distance because ball speed is directly tied to clubhead speed. The well-timed wrist snap helps strike and compress the golf ball. This compression leads to better energy transfer and optimized spin-both of which contribute to longer, more controlled shots.

What is lacking in the art is a check valve to control the flow of a fluent weight that can be adjusted to an individual golfer's swing to synchronize the entire kinetic chain movement of the golfer leading to a more powerful golf ball strike.

SUMMARY OF THE INVENTION

A golf club incorporating a fluid-based dynamic mass redistribution system is disclosed. The golf club includes a hollow shaft defining a shaft internal chamber between a proximal end and a distal end, and a hollow club head coupled to the distal end, the club head having an internal cavity fluidly coupled to the shaft internal chamber. A check valve assembly is disposed within the shaft internal chamber and comprises an expandable sleeve with an outer wall frictionally engaging the chamber wall and a threaded inner wall; a valve chamber having a threaded upper section engaging the expandable sleeve, and a frusto-conical lower section terminating in a centrally located aperture; a check valve conforming to the frusto-conical lower section and sealing the aperture under vacuum conditions; a stationary plate mounted above the lower section, the plate having a central passage and at least one vent; and a safety lock with a threaded engagement to the valve chamber and a locking arm extending through the plate to secure the check valve. A fluent liquid weight medium is disposed within the sealed internal chamber of the shaft and club head. The internal chamber is evacuated to a vacuum state via the check valve, which retains the vacuum. During a swing, the fluent weight medium transitions from a first position within the shaft to a second position within the club head, thereby increasing mass at the striking face during ball impact. During a backswing, the medium shifts back toward the shaft, reducing inertial resistance. This mass redistribution enhances swing efficiency and increases the momentum transfer to the golf ball.

An objective of the invention is to provide an adjustable weighted golf club.

Another objective of the invention is to provide an improved golf club that does not change the appearance of the club.

Yet still another objective of the invention is to provide an improved golf club that allows for weight transfer without any moving parts.

Yet another objective of the invention is to provide an improved golf club that allows for weight transfer using different types and quantity of medium.

Another objective of the invention is to provide an improved golf club that allows for adjustment of the center of gravity.

Other objectives and advantages of this invention will become apparent from the following description taken in conjunction with any accompanying drawings wherein are set forth, by way of illustration and example, certain embodiments of this invention. Any drawings contained herein constitute a part of this specification, include exemplary embodiments of the present invention, and illustrate various objects and features thereof.

KNOWN PRIOR ART

AU200053478; U.S. Pat. Nos. 3,516,673; 3,843,135; 3,993,314; 4,541,631; 4,655,458; 5,803,829; 5,082,279; 6,146,287; 3,625,513; 2,432,450; 1,561,595 US2008/0127721; US2019/0269982; US2009/0149269.

DETAILED DESCRIPTION OF THE PREFERRED EMBODIMENT

Figure 1:
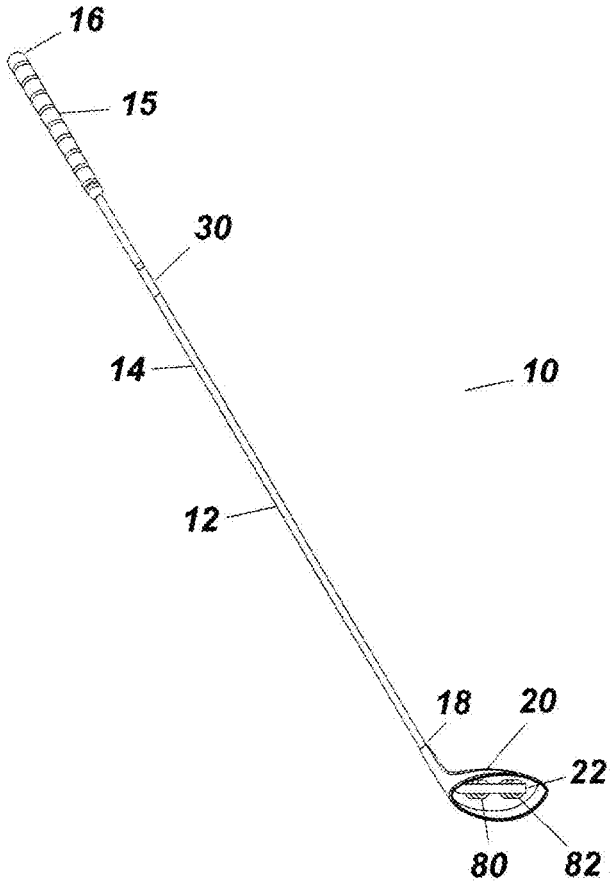
FIG. 1 is a perspective view of a golf club with a rear of a hollow club head removed according to an embodiment.
Figure 2:
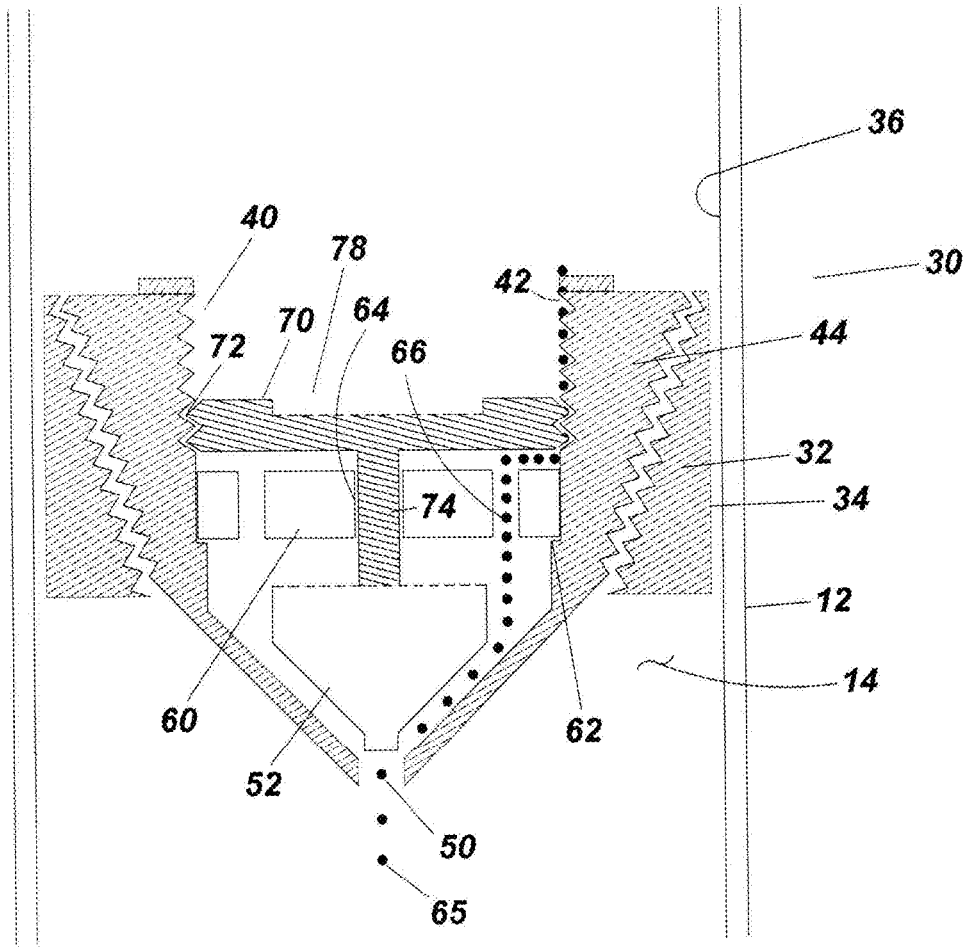
FIG. 2 is a cross-sectional view of the club head shaft illustrating a check valve.
Figure 3:
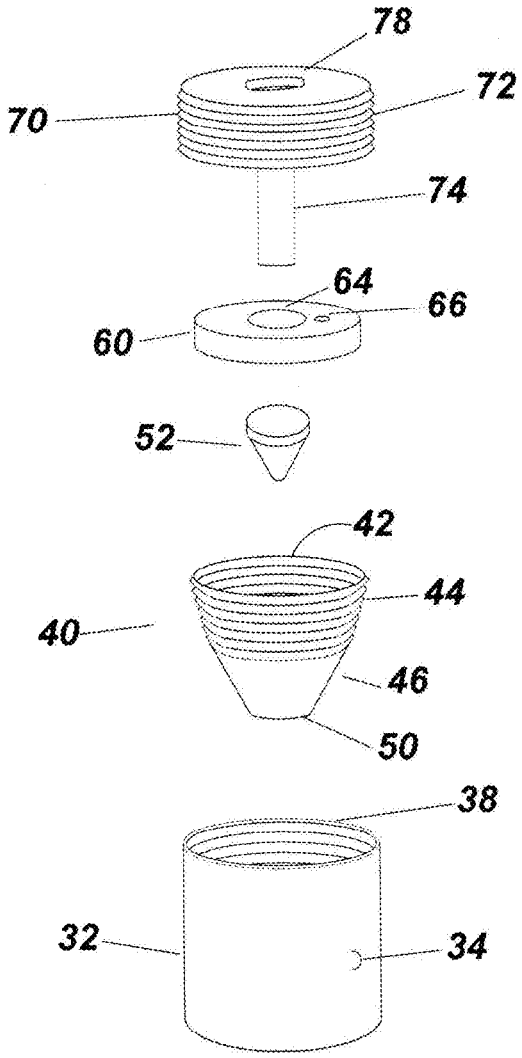
FIG. 3 is an exploded view of the check valve.

According to an embodiment, a golf club has a fluent medium, such as liquid mercury, galinstan/indium, pure gallium, or bromine contained within a chamber extending from the club head through at least a portion of the length of the club shaft controlled by an adjustable check valve. The fluent medium may be displaced from the club head to the shaft mounted check valve and from the shaft mounted check valve to the club head during a golf swing. This dynamic displacement provides a lightweight club head at the top of a backswing so as not to compromise the ability of the golfer to begin to accelerate the club head during the initiation of a downswing, yet also provides a club head with more mass/weight at the point of impact. The check valve assembly can be moved along the length of the shaft wherein movement of the medium is limited and arrested. The result is that the golf swing creates a greater force to be applied to a golf ball by dynamically moving the fluent weight thereby increasing the flight distance of the golf ball upon impact. It is noted that air has mass and can be considered a medium. In considering what medium to be used, vacuuming out air as a medium and replacing the air with another medium would not violate any USGA rules, wherein there is nothing in the rulebook that requires the medium to be air. Air molecules react to centrifugal force just like mercury would react.

The check valve assembly can be positioned to address an individual golfer wherein the weight medium accommodates a golfer's unique back swing by determining where the check valve assembly might be positioned to minimize the travel time for the medium to travel-back to the shaft and the reload time. The objective is to maximize the point of impact with the dynamic medium sudden arrival (through centrifugal force) of additional mass. This avoids compromising the golfer's ability to accelerate the club head with unnecessary weight.

Where that medium is located in the shaft influences the ability to accelerate the club head and each golfer is able to make adjustments accordingly. The overall appearance of the club is unchanged and there is no moving parts.

Referring to FIGS. 1-4, a golf club 10 includes a hollow shaft 12 defining a shaft internal chamber 14 between a proximal end 16 and a distal end 18, and a hollow club head 20 coupled to the distal end 18. The club head 20 having an internal chamber 22 fluidly coupled to the shaft internal chamber 14. The proximal end 16 includes a removable hand grip 15.

A check valve assembly 30 is disposed within an internal chamber 14 formed by the shaft. Preferably the shaft is coated with Teflon or the like coating material allowing ease of medium movement. The assembly comprises an expandable sleeve 32 with an outer wall 34 frictionally engaging the chamber inner wall 36, and inner wall 38 of the expandable sleeve 32 is threaded. A valve chamber 40 having a threaded upper section 42 with outer threads 44 is used for engaging the expandable sleeve 32. A frusto-conical lower section 46 terminates in a centrally located aperture 50. A check valve 52 conforming to the frusto-conical lower section 46 is used to seal the aperture 50 when vacuum conditions exist in the chamber 14. The check valve 52 may be wedge shaped, as depicted, to provide higher surface contact for sealing. Alternatively, a conventional ball can be used to provide a seal for the aperture 50. Preferably the check wedge is constructed from rubber or the like material known for its ability to create a seal. Within the valve chamber 40, stationary plate 60 is position directly above the check valve 52 having an outer edge providing a seal to the valve chamber 40, further engaging a base edge 62. A central opening 64 is used for receipt a safety lock 70.

Figure 4:
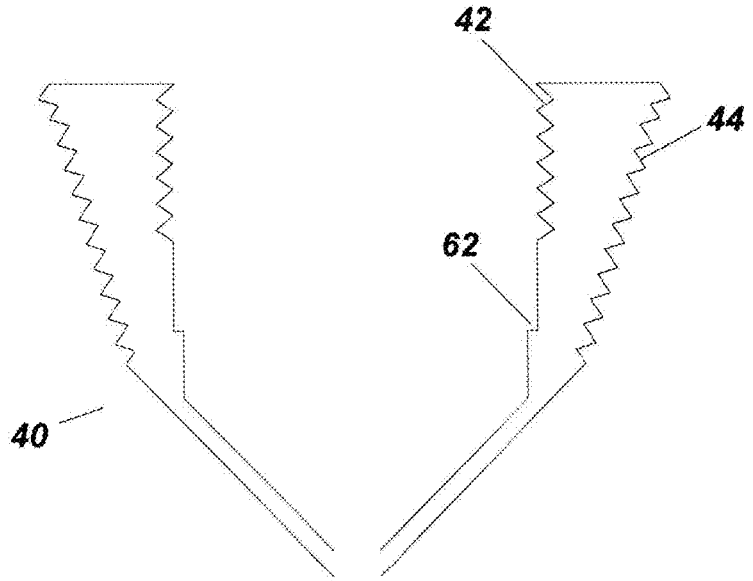
FIG. 4 is a perspective view of the nozzle plate.

Placing a vacuum through the proximal end 16 of the shaft 12 allows air to be evacuated along the flow line 65 illustrated in FIG. 4. The stationary plate 60 having a central passage 64 and at least one vent 66 to allow air to be drawn from through the chamber 14. The safety lock 70 having an edge wall 72 threadingly secured to the valve chamber 60 threaded upper section 42. The safety lock 70 includes a locking arm 74 extending through the stationary plate 60 to secure the check valve 52 in the lower section 46 to prevent loss of the vacuum seal. A fluent liquid weight medium 80 is disposed within the sealed internal chamber 14 extending through the shaft 14 and club head 20. The internal chamber 14 is evacuated to a vacuum state via the check valve assembly.

During a golf swing, the fluent weight medium transitions from a first position within the shaft 12 to a second position within the club head 20, thereby increasing mass at the striking face 82 during golf ball impact. During a backswing, the medium 80 shifts back into the shaft 12, reducing inertial resistance. This mass redistribution enhances swing efficiency and increases the momentum transfer to the golf ball.

The fluent weight medium is preferably liquid mercury, galinstan, pure gallium, or bromine. Once the medium is placed in the chamber 14, the check valve assembly 30 is inserted into the chamber 14. The actual placement of the check valve assembly 30 is dependent upon the golfer's individual preference. As previously stated, the expandable sleeve 32 is of the assembly 30 is first positioned within the chamber 14, the expansion member 40 is threadingly engaged thereto. These components can be inserted by a long neck screwdriver into the open proximal end 15 of the shaft 12. The check valve 52 and the stationary plate 60 are further installed.

A vacuum is then attached to the proximal end 16 of the shaft 12 drawing air from the chamber 14. Once the air is withdrawn, the check valve 52 seals the aperture 50. The safety plug 70 is then inserted into the shaft and threaded to the valve chamber 70. A slot 78 on the top of the safety plug can be rotated by a long stem screwdriver. The fluent weight medium 80 is now contained within the sealed chamber 22 extending from the club head through at least a portion of the length of the shaft controlled by an adjustable check valve assembly 30. With air evacuated from the chamber, only a predetermined amount of fluent weight medium is contained within the chamber 14. The amount of the fluent weight medium is much smaller than the overall evacuated area defined within the vacuum chamber; thus, the fluent weight medium is able to flow or be quickly displaced from one end of the chamber 14 to the other end. Accordingly, during a golf swing, the fluent weight medium is displaceable along a length of the chamber between the check valve assembly 30 and the club head 20. The part of the chamber extending within the shaft 12 may have a constant pre-determined inner diameter along a full length thereof or have a slight taper. In turn, the chamber within the club head 20 may have a constant inner diameter along a length thereof. This arrangement ensures that the fluent weight material is able to readily and quickly flow from the club head 20 to the shaft 12 through the chamber 14 during a backswing, especially at the top of the backswing wherein gravity provides assistance. The chamber 14 preferably includes an anti-friction lining to further ensure the quick displacement of the fluent weight medium 80 in the chamber 14.

According to an example, the hollow club head may be made of a lightweight metal or composite material and may weigh only about 6 ounces. The fluent weight medium may be 2 to 3 ounces of liquid mercury which is able to be entirely received within the conduit of the vacuum chamber extending entirely within the club head. Thus, a ratio of a weight of the mercury to the weight of the club head may be 1:3 to 1:2. Other ratios of the weight of the mercury to the weight of the club head may be utilized such as within ranges of 1:3 to 2:3, 2:3 to 1:1, or 1:3 to 1:1. In the example in which 3 ounces of mercury is utilized, the weight of the club head increases 150% between when the initiation of movement of the club head during a downswing occurs and when the club head strikes the golf ball. This permits greater acceleration at the point of starting a downswing and greater mass/weight of the club head at the point of striking the golf ball such that greater striking force may be generated and applied to the golf ball and a longer flight distance of the golf ball may be the result.

Referring to the set of images in FIGS. 5A to 5H, at a set-up point of a golf swing (see position in FIG. 5A), the fluent weight medium in the golf club is acted upon by gravity to be fully located in the part of the chamber extending within the club head 20. When the player starts to swing the golf club 10 upwardly during a backswing, the fluent weight medium receives the action of gravity to move from the raised club head 20 to a part of the vacuum chamber within the shaft 12 (see positions in FIGS. 5B, 5C and 5D). When the golf club is swung back to a top position (i.e., see the position in FIG. 5D), the fluent weight material resides in the proximal end of the vacuum chamber located in the shaft 12 nearest the check valve assembly 30. Thereafter, when the player starts to swing the golf club downwardly, the fluent weight medium is acted upon by centrifugal force to start moving within the vacuum chamber from the shaft 12 (such as near the grip 15) to the club head 20 (see the position in FIG. 5E).

At a point of impact of the club head with a golf ball, the fluent weight medium is located entirely within the club head to add weight/mass to the club head. Accordingly, at the point of impact, forces corresponding to mass/weight of the club head (including the fluent mass medium) and acceleration of the club head (which may be increased due to the lighter club head when the fluent mass medium initially resides in the shaft instead of the club head) are transmitted to the golf ball through the striking face of the club head. Thus, the fluent weight medium displaced within the vacuum chamber within the golf club permits a greater driving force to be applied to the golf ball such that the flight distance of the golf ball may be increased.

The fluent weight medium contained in the chamber may be any material which can be moved/displaced along the full length of the vacuum chamber. Thus, the medium may be a solid or liquid or mixtures thereof that are able to readily flow within the vacuum chamber between the proximal and distal ends thereof. For purposes of example, the medium may be liquid mercury or like substance. Alternatively, metal beads or the like such as iron or the like may be used. A mixture of a solid and liquid may also be used.

In an embodiment, the club head is 3-D printed and constructed of titanium. In this embodiment, the hollow chamber behind the striking surface can be uniquely configured to incorporate the impact plate. The configurations allow numerous design possibilities for distributing the medium on the backside of the striking surface.

Figure 5A:
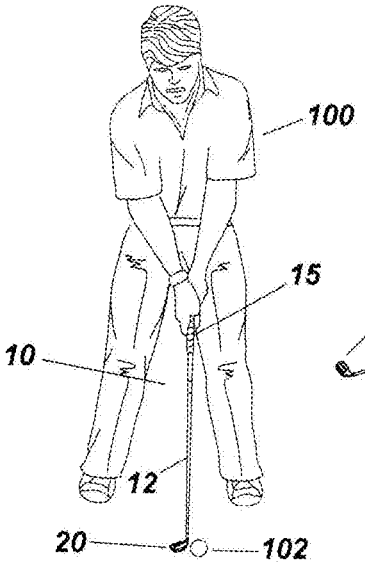
FIGS. 5A to 5H is a set of views demonstrating a typical golf swing.

FIG. 5A, the golfer 100 is considered to be addressing the golf ball 102 wherein the golfer 100 holds the golf grip 15. The medium would be settled in the club head 20.

Figure 5B:
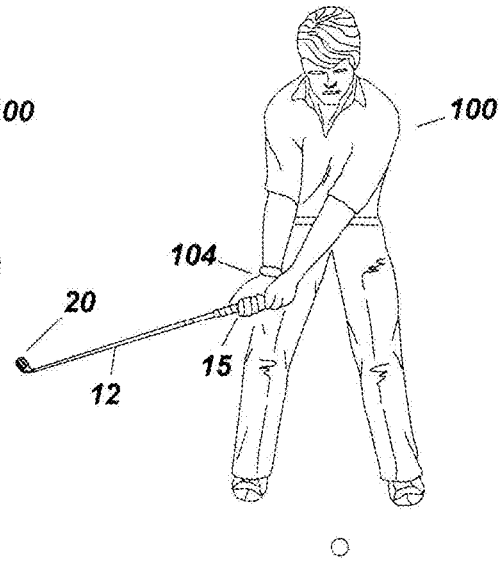

FIG. 5B, the golfer 100 is drawing the club head 20 upward, the shaft 12 is angled below the golfer's hands 104 wherein the medium is still settled in the club head 20.

Figure 5C:
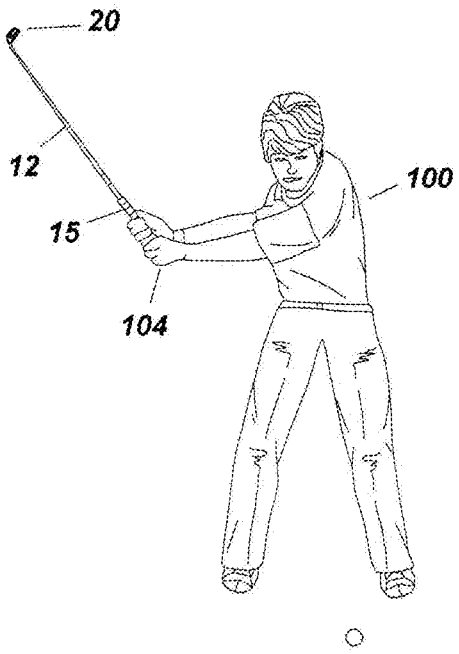

FIG. 5C, the golfer 100 is drawing the club head 20 upward, the shaft 12 is angled above the golfer's hands 104 wherein the medium is draining into the shaft 12.

Figure 5D:
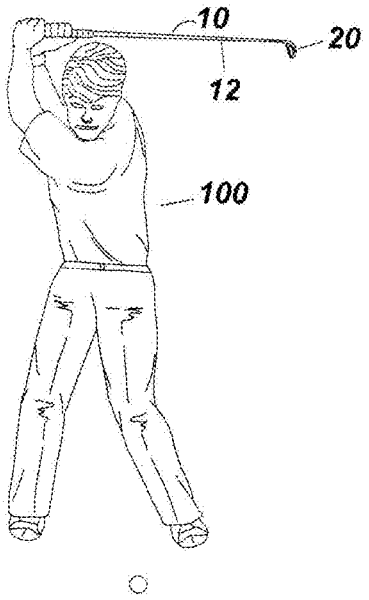

FIG. 5D, the golfer 100 is in a full backswing, the shaft 12 is parallel with the ground, the medium is settled in the shaft 12.

Figure 5E:
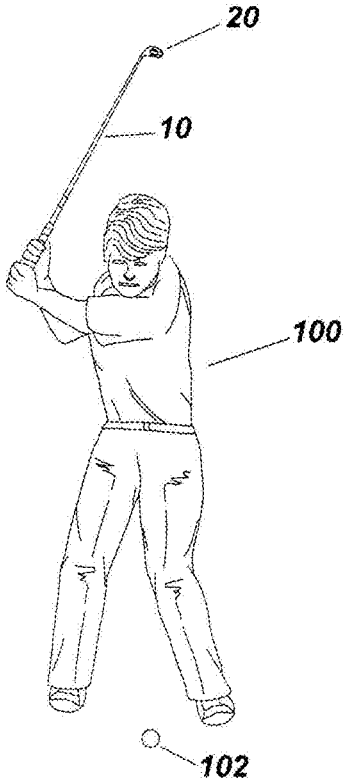

FIG. 5E, the golfer 100 is beginning the forward swing with the acceleration of the shaft 12 moving the medium from the shaft toward the club head 20.

Figure 5F:
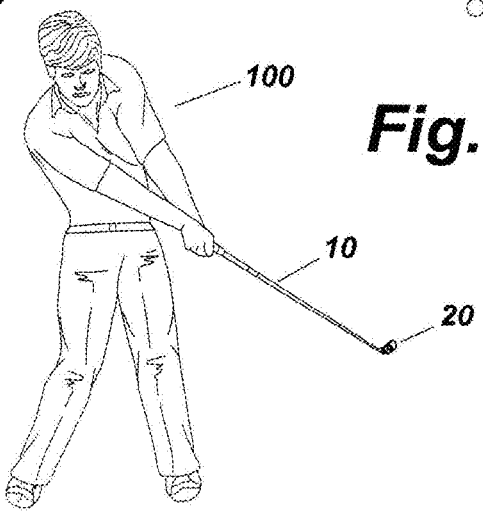

FIG. 5F, the golfer 100 has struck the golf ball with the full amount of the medium having transferred into the club head 20. Through the adjustability of the check valve assembly, the medium can be synchronized to transfer the weight to the club head at the moment of golf ball impact thereby gaining the most advantage.

Figure 5G:
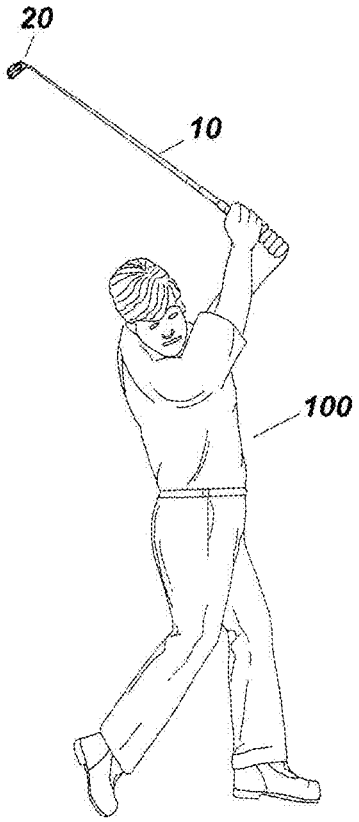

FIG. 5G, the golfer 100 is following through wherein the weight of the club head assists in rotating the golfer to face the ball direction to maximize the distance and direction that the golf ball has been struck.

Figure 5H:
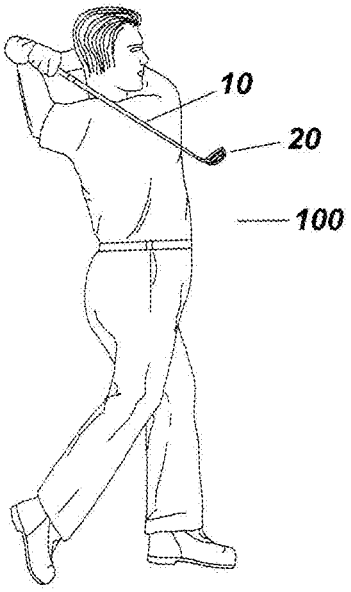

FIG. 5H, the golfer 100 has completed the golf swing.

The term "coupled" is defined as connected, although not necessarily directly, and not necessarily mechanically. The use of the word "a" or "an" when used in conjunction with the term "comprising" in the claims and/or the specification may mean "one," but it is also consistent with the meaning of "one or more" or "at least one." The term "about" means, in general, the stated value plus or minus 5%. The use of the term "or" in the claims is used to mean "and/or" unless explicitly indicated to refer to alternatives only or the alternative are mutually exclusive, although the disclosure supports a definition that refers to only alternatives and "and/or."

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a method or device that "comprises," "has," "includes" or "contains" one or more steps or elements, possesses those one or more steps or elements, but is not limited to possessing only those one or more elements. Likewise, a step of a method or an element of a device that "comprises," "has," "includes" or "contains" one or more features, possesses those one or more features, but is not limited to possessing only those one or more features. Furthermore, a device or structure that is configured in a certain way is configured in at least that way, but may also be configured in ways that are not listed.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A golf club, comprising:

a hollow shaft having a proximal end and a distal end forming a shaft chamber therebetween;

a grip secured to the proximal end of the shaft;

a hollow club head coupled to said distal end of said shaft, said club head having a club head chamber fluidly coupled to said shaft chamber, said club head defining a striking face;

an adjustable check valve assembly positioned within said shaft chamber, said check valve assembly comprising:

an expandable sleeve having an outer wall frictionally engaging an inner surface of said hollow shaft;

a valve chamber having an upper section and a lower section, said upper section including a threaded external surface constructed and arranged to engage said expandable sleeve, said lower section having a frusto-conical shape leading to a centrally disposed aperture;

a check valve conforming to said frusto conical shape, said check valve constructed and arranged to seal said aperture in the presence of a vacuum within said chamber;

a stationary plate having an outer edge sealingly securable to said valve chamber, said stationary plate having a centrally disposed passageway and at least one vent hole;

a safety lock member threadingly engaging said valve chamber with a locking arm extending through said stationary plate passageway for securing said check valve in said valve chamber aperture; and a fluent liquid weight medium disposed within said chamber;

wherein the chamber of the said shaft and club head is evacuated of air wherein said check valve maintains the vacuum created and said safety lock member further secures said check valve in a position to prevent loss of the vacuum;

whereby, during a golf swing, said fluent liquid weight medium is displaced from a first position within said shaft to a second position within said club head to increase the mass at the striking face during impact with a golf ball, and is displaced from the club head back toward the shaft during a backswing to reduce inertial resistance, thereby enhancing swing efficiency and increasing the resulting distance of golf ball flight.

2. The adjustable weighted golf club according to claim 1, wherein said internal chamber is lined with an anti-friction lining.

3. The adjustable weighted golf club according to claim 2, wherein said anti-friction lining is coated with polytetrafluoroethylene (PTFE).

4. The adjustable weighted golf club according to claim 2, wherein said fluent weight medium is a liquid selected from the group consisting of: mercury, galinstan, pure gallium, or bromine.

5. The adjustable weighted golf club according to claim 1, wherein said fluent weight medium is 2 to 3 ounces of liquid mercury.

6. The adjustable weighted golf club according to claim 1, wherein a ratio of a weight of said amount of said fluent weight medium within said vacuum chamber to a weight of said hollow club head is within a range of 1:3 to 1:1.

7. The adjustable weighted golf club according to claim 1, wherein a ratio of a weight of said amount of said fluent weight medium within said vacuum chamber to a weight of said hollow club head is within a range of 2:3 to 1:1.

8. The adjustable weighted golf club according to claim 1, wherein said vacuum chamber extends at least half the full length of said shaft.

9. The adjustable weighted golf club according to claim 1, wherein said expandable sleeve is tapered to conform with the shaft internal chamber.

10. The adjustable weighted golf club according to claim 1, wherein said valve chamber is constructed from brass.

11. The adjustable weighted golf club according to claim 1, wherein said check valve is wedge shaped.

12. The adjustable weighted golf club according to claim 1, wherein said check valve is a spherical shaped.

13. The adjustable weighted golf club according to claim 1, wherein said expandable sleeve is tapered.

* * * * *